US008823756B2

(12) United States Patent
Kobayashi

(10) Patent No.: US 8,823,756 B2
(45) Date of Patent: Sep. 2, 2014

(54) DOUBLE-SIDED RECEIPT PRINTING METHOD AND DOUBLE-SIDED RECEIPT PRINTER

(75) Inventor: Naoki Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 190 days.

(21) Appl. No.: 13/461,861

(22) Filed: May 2, 2012

(65) Prior Publication Data

US 2012/0279406 A1 Nov. 8, 2012

(30) Foreign Application Priority Data

May 2, 2011 (JP) ..... 2011-102757

(51) Int. Cl.
*B41J 2/32* (2006.01)

(52) U.S. Cl.
USPC ..... 347/171

(58) Field of Classification Search
USPC ..... 347/171; 400/82, 188, 120.01
See application file for complete search history.

(56) References Cited

U.S. PATENT DOCUMENTS 7,782,349 B2 8/2010 Baba et al.
8,276,808 B2 * 10/2012 Goodwin, III ..... 347/171
8,390,659 B2 * 3/2013 Masuda ..... 347/171

FOREIGN PATENT DOCUMENTS

JP 2007-320188 A 12/2007
JP 2009-123028 A 6/2009

* cited by examiner

*Primary Examiner* — Kristal Feggins
(74) *Attorney, Agent, or Firm* — Nutter McClennen & Fish LLP; John J. Penny, Jr.; Joshua I. Rudawitz

(57) ABSTRACT

A first printhead that prints on one side of the paper, a second printhead that prints on the other side of the paper, and a cutter are disposed to the paper conveyance path with a specific gap therebetween approaching the paper exit for the paper, and a conveyance unit that conveys the paper through the conveyance path in a device that prints duplex receipts. Based on reception of a transaction end statement, the printer prints part of the transaction information by the first printhead; prints the remaining part of the transaction information by the second printhead; prints store information, the length of which fits between the cutter and the first printhead, by the first printhead after printing the transaction information; and then cuts the paper by the cutter at a position between the area where the transaction information was printed and the area where the store information was printed.

7 Claims, 6 Drawing Sheets

DOUBLE-SIDED RECEIPT PRINTING METHOD AND DOUBLE-SIDED RECEIPT PRINTER

Priority is claimed under 35 U.S.C. §119 to Japanese Application No. 2011-102757 filed on May 2, 2011, which is hereby incorporated by reference in its entirety.

BACKGROUND

1. Technical Field

The present invention relates to a double-sided receipt printing method and a double-sided receipt printer that produce receipts by printing on both sides of the receipt paper using two printheads disposed with a gap therebetween in the paper conveyance direction and then cutting the paper after printing is completed. More specifically, the invention relates to a double-sided receipt printing method and double-sided receipt printer that can reduce paper wasted by white space formed at the leading end of the receipt without needing to reverse the paper in the conveyance direction.

2. Related Art

Printers for producing receipts are commonly used in supermarkets and other retail stores. These printers include duplex printers that can print on both sides of the paper in order to use paper more efficiently.

Japanese Unexamined Patent Appl. Pub. JP-A-2007-320188 teaches technology enabling a duplex printer to split the print data between the front and back sides of the paper for fast printing.

Japanese Unexamined Patent Appl. Pub. JP-A-2009-123028 teaches technology for shortening the length of the receipt by dividing the transaction information printed on the receipt between both sides of the paper and printing to areas other than where the store information is printed.

The cutter for cutting the paper after printing, a first printhead that prints on one side of the paper, and a second printhead that prints on the other side of the paper are disposed in this order with a specific gap therebetween from the downstream end of the paper conveyance direction in the duplex printers described above. As a result, the cutter and the upstream side printhead are physically separated a specific distance, and white space equal to this distance is formed at the leading end of the receipt on the side printed by the upstream side printhead after the paper is cut unless some special action is taken.

The paper could be reversed in the paper feed direction and moved to a specific position before printing starts to reduce this paper waste, but this method requires time to move the paper and some mechanical means of preventing paper jams, and thus has problems.

A JP-A-2007-320188 is silent about solving this problem. JP-A-2009-123028 describes the white space created by the distance between the two printheads, but does not address white space created by the distance between the cutter and the printheads.

SUMMARY

A double-sided receipt printing method according to the present invention is a double-sided receipt printing method that produces receipts by printing on both sides of paper using two printheads disposed with a specific gap therebetween in the paper conveyance direction, and then cutting the paper after printing, and can reduce paper wasted by white space at the leading end of the receipt without conveying the paper in reverse.

One aspect of the invention is a double-sided receipt printing method for a device that prints transaction information and store information for each transaction on paper, and produces a receipt using both sides of the paper, wherein: the device has a first printhead that prints on one side of the paper, a second printhead that prints on the other side of the paper, and a cutter disposed to the paper conveyance path with a specific gap therebetween approaching a paper exit for the paper, and a conveyance unit that conveys the paper through the conveyance path; and the printing method includes steps of: starting conveyance of the paper by the conveyance unit, printing part of the transaction information by the first printhead, and printing the remaining part of the transaction information by the second printhead, based on reception of a transaction end statement; printing the store information, the length of which in the paper conveyance direction is a length that fits between the cutter and the first printhead, by the first printhead after printing the transaction information; and stopping conveyance by the conveyance unit after printing the store information, and cutting the paper by the cutter at a position between the area where the transaction information was printed and the area where the store information was printed.

A double-sided receipt printing method according to another aspect of the invention preferably also has a step of dividing the transaction information for each transaction into transaction information printed by the first printhead and the second printhead before printing the transaction information.

Further preferably, the transaction information for each transaction is divided so that the length of the transaction information printed by the second printhead is greater than the length of the transaction information printed by the first printhead by an amount equal to the distance between the first printhead and second printhead.

Yet further preferably, the length of the store information is shorter than the distance between the cutter and the first printhead.

Another aspect of the invention is a double-sided receipt printer that prints transaction information and store information for each transaction on paper, and produces a receipt using both sides of the paper, wherein the printer has: a first printhead that prints on one side of the paper, a second printhead that prints on the other side of the paper, and a cutter disposed to the paper conveyance path with a specific gap therebetween approaching a paper exit for the paper, and a conveyance unit that conveys the paper through the conveyance path; and starts conveyance of the paper by the conveyance unit, prints the transaction information by the first printhead, and prints the store information by the second printhead, based on reception of a transaction end statement; prints the store information, the length of which in the paper conveyance direction is a length that fits between the cutter and the first printhead, by the first printhead after printing the transaction information; and stops conveyance by the conveyance unit after printing the store information, and cuts the paper by the cutter at a position between the area where the transaction information was printed and the area where the store information was printed.

A double-sided receipt printer according to another aspect of the invention preferably also has a data allocation unit that divides the transaction information for each transaction into transaction information printed by the first printhead and the second printhead before printing the transaction information.

Further preferably, the data allocation unit divides the transaction information for each transaction so that the length of the transaction information printed by the second printhead is greater than the length of the transaction information printed by the first printhead by an amount equal to the distance between the second printhead and first printhead.

Other objects and attainments together with a fuller understanding of the invention will become apparent and appreciated by referring to the following description and claims taken in conjunction with the accompanying drawings.

DESCRIPTION OF EMBODIMENTS

Figure 1:
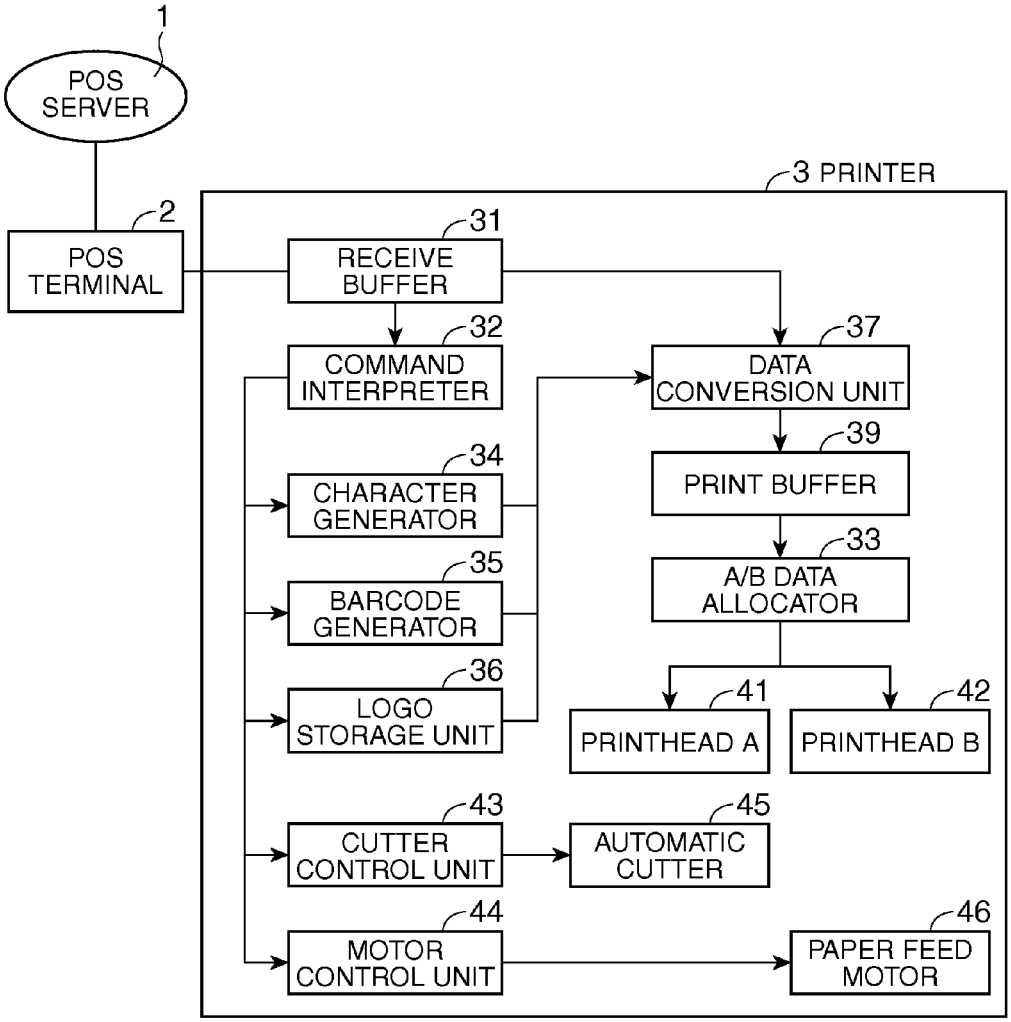
FIG. 1 is a block diagram showing the configuration of a double-sided receipt printer according to a preferred embodiment of the invention.

A preferred embodiment of the present invention is described below with reference to the accompanying figures. The scope of the invention is not limited to this embodiment. Note also that identical or like parts are identified by the same reference numerals or markings in the figures and following description.

Double-Sided Receipt Printer

Figure 2:
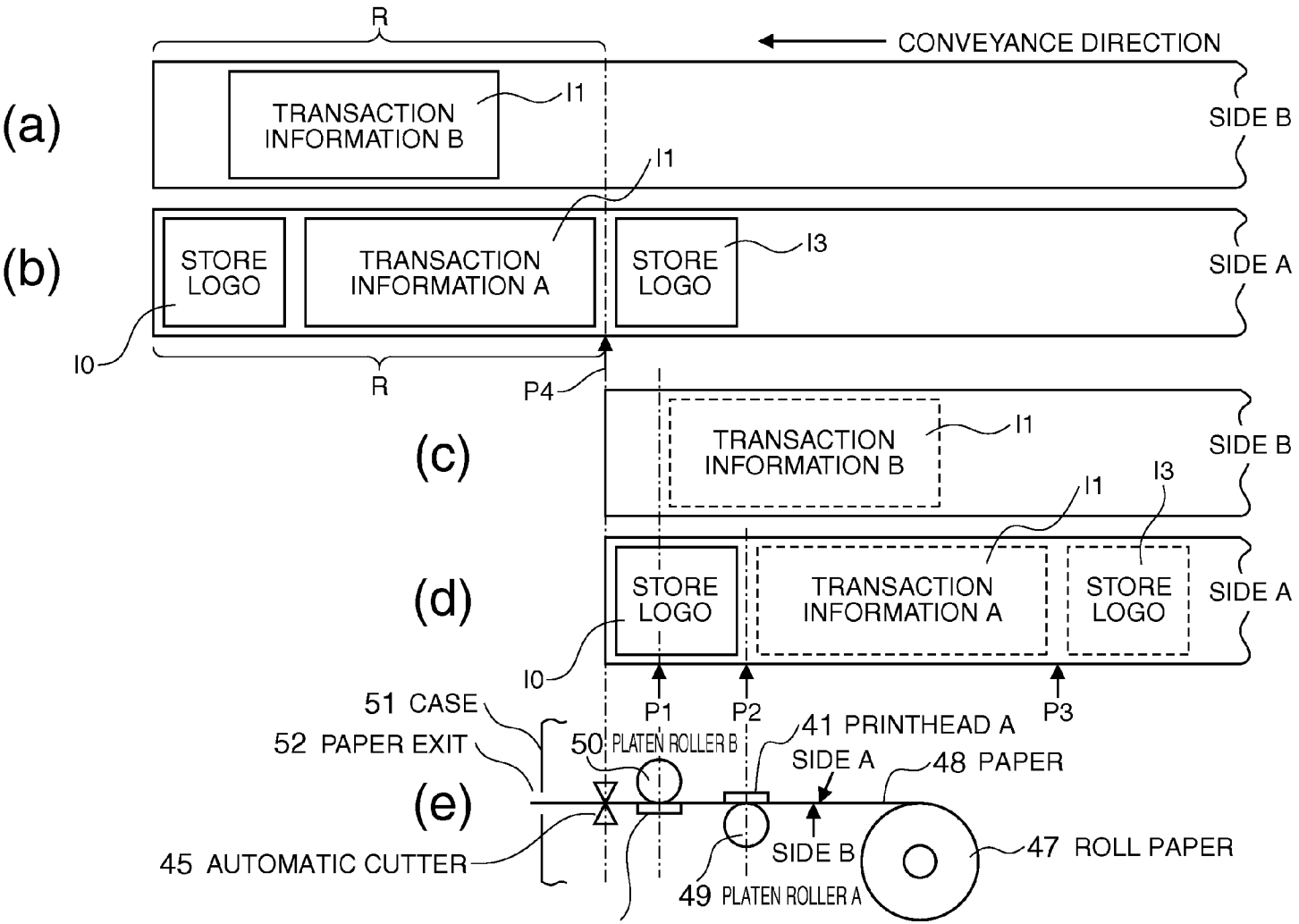
FIG. 2 describes receipt printing in the printer.

A double-sided receipt printer (duplex printer) according to this embodiment of the invention is described below with reference to FIG. 1 and FIG. 2. FIG. 1 is a block diagram showing the configuration of a double-sided receipt printer according to a preferred embodiment of the invention. FIG. 2 describes receipt printing by the printer 3.

The printer 3 shown in FIG. 1 is an example of a double-sided receipt printer according to this embodiment of the invention. This printer 3 reduces white space on the paper due to the distance between the paper cutter and printhead by continuing printing to print store information, such as the store logo that is printed at the leading end of each receipt, for the next receipt after printing transaction information with the printhead located on the upstream side in the conveyance direction of the paper.

As shown in FIG. 1, a printer 3 according to this embodiment of the invention is installed in a retail store, for example, as part of a POS system, and prints receipts as requested by a POS terminal 2 that functions as a cash register terminal. The POS server 1 is a computer system to which plural POS terminals 2 are connected, although only one is shown in FIG. 1, and runs processes for managing the POS terminals 2 and collecting and managing data acquired from the POS terminals 2.

A POS terminal 2 is installed at each checkout counter in the store, and includes a computer terminal, keyboard, barcode reader, and display, for example. A POS application that executes various processes, and a printer 3 driver are also installed in each POS terminal 2, and used to process data. To output a receipt, print data (a print job) for a receipt is sent from the POS terminal 2 to the printer 3. Note that this print data is expressed by specific printer control commands.

The printer 3 is a printer connected to the POS terminal 2 for printing receipts, and is located beside the POS terminal 2. The printer 3 in this embodiment is a duplex thermal printer having line heads. The printer 3 has the parts shown in FIG. 1, and the receive buffer 31 is a data storage unit rendered by RAM for temporarily storing print data (simply "commands" below) sent from the POS terminal 2.

The command interpreter 32 sequentially interprets the commands received in the receive buffer 31, and outputs commands to other parts based on the results of interpreting the commands.

The character generator 34 is a part that generates images of the characters to be printed as instructed by the command interpreter 32. More specifically, the character generator 34 stores character fonts, and outputs font data corresponding to the character codes specified by the command interpreter 32.

The barcode generator 35 is apart that generates barcode images as instructed by the command interpreter 32. More specifically, the barcode generator 35 generates and outputs a barcode representing values specified by the command interpreter 32.

The logo storage unit 36 is a part that identifiably stores predetermined image data, such as an image of the store logo printed at the beginning of the receipts, and reads and outputs image data as instructed by the command interpreter 32. The logo storage unit 36 is rendered using nonvolatile memory (NVRAM), and the store logo and images for advertisements and coupons that are also printed on receipts are stored in memory.

The data conversion unit 37 is a part that generates bitmap data for the images printed on side A, which is one side, and side B, which is the other side, of the paper 48 shown in FIG. 2. More specifically, the data conversion unit 37 converts data for image objects output from the character generator 34, barcode generator 35, and logo storage unit 36 to data for each pixel.

Note that the command interpreter 32, A/B data allocator 33 described below, character generator 34, barcode generator 35, logo storage unit 36, and data conversion unit 37 are rendered using a CPU, RAM, and ROM, for example, and various processes are executed as a result of the CPU operating according to a program stored in ROM.

The print buffer 39 is apart that stores bitmap data output from the data conversion unit 37, and is RAM.

The A/B data allocator 33 is a part that, after data for one transaction (one receipt) is stored in the print buffer 39, divides the data into data printed on side A of the paper 48 and data printed on side B, and specifies whether particular data is printed on side A or side B.

As shown in FIG. 2, the printer 3 has printhead A 41 as a first printhead and printhead B 42 as a second printhead as parts used for printing respectively on side A and side B. The paper feed path (conveyance path) of the printer 3 is shown schematically in FIG. 2 (*e*).

The printheads are line heads with heat elements (resistors), and as shown in FIG. 2 (*e*) print on the paper 48 pressed thereto by the platen roller A 49 and platen roller B 50 while being conveyed between the printheads and platen rollers.

The paper 48 handling system of the printer 3 includes a roll paper 47 compartment, the platen roller A 49 and platen roller B 50 described above, a paper feed motor 46 (FIG. 1) that drives the platen roller, a motor control unit 44, an automatic cutter 45 (cutter) for cutting the paper 48, a cutter control unit 43, and a paper 48 paper exit 52 in the case 51 of the printer 3. The platen roller A 49, platen roller B 50, and paper feed motor 46 render a conveyance unit.

Printhead A 41 (first printhead), printhead B 42 (second printhead), and the automatic cutter 45 are disposed with specific intervals therebetween from the upstream side of the paper conveyance path to the paper exit 52 at the downstream end.

The roll paper 47 is conveyed as the paper 48 between the printheads and platen rollers that are pressed together by rotation of the platen rollers to the paper exit 52. While being conveyed, the roll paper 47 is printed on by the printheads, cut by the automatic cutter 45 at a specific position where the receipt ends, and discharged from the printer 3.

Receipts

Figure 3:
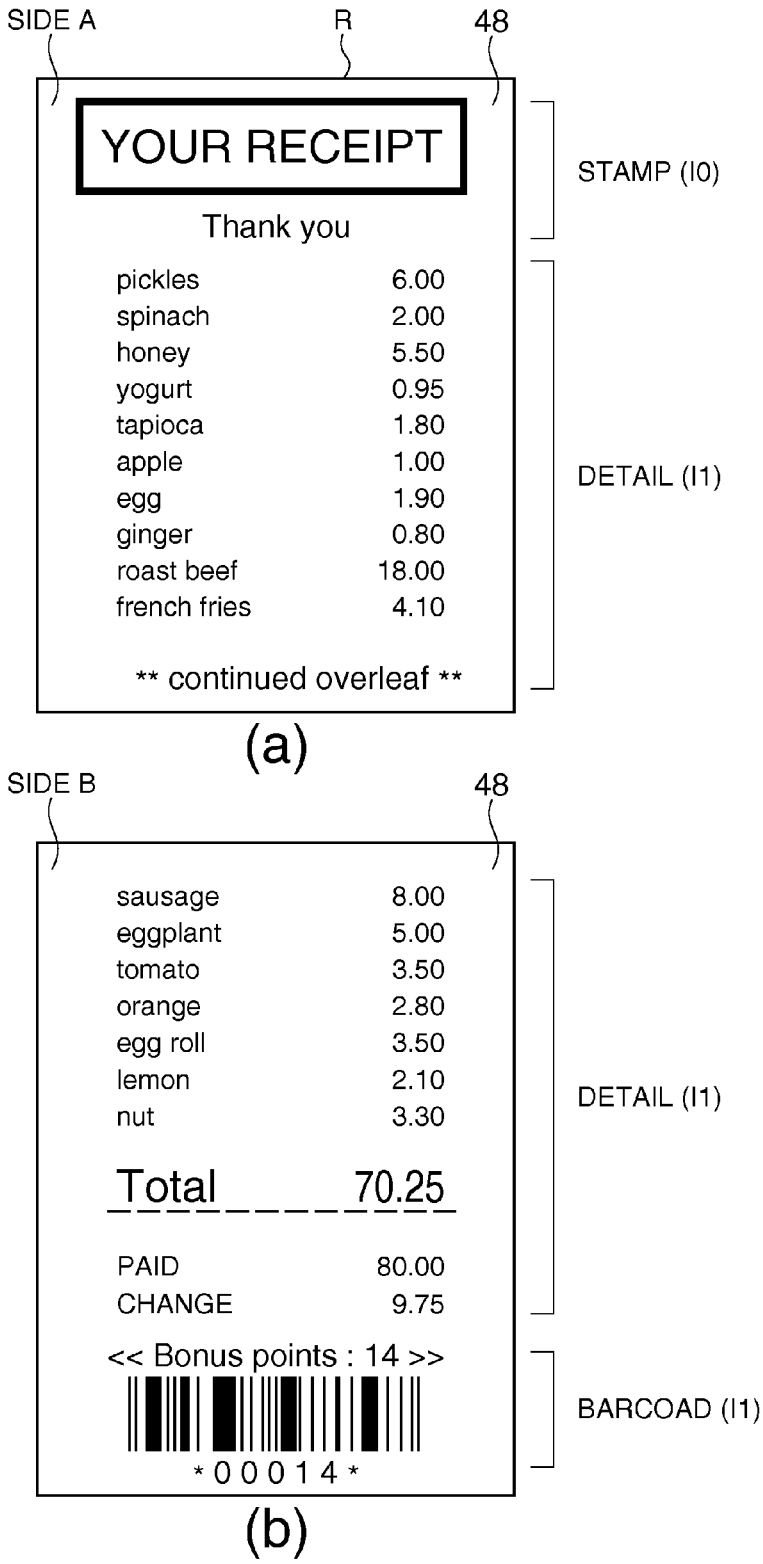
FIG. 3 shows an example of a receipt produced by the printer.

A receipt printed by the foregoing printer is described next with reference to FIG. 3. FIG. 3 shows an example of a receipt produced by the printer 3. FIG. 3(*a*) shows one side of the receipt R printed on the paper 48. This side is referred to as side A in this embodiment. As shown in the figure, the content printed on this side includes a stamp and part of the receipt detail. FIG. 3(*b*) shows the other side of the receipt R printed on the paper 48. This side is referred to as side B in this embodiment. As shown in the figure, the content printed on this side is the remaining receipt detail and a barcode.

A printer 3 configured as described above is characterized by the process used to produce receipts, and more particularly by the method of printing store information, such as a store logo, that is printed at the beginning of the receipt, as described specifically below. The printed content of a receipt R printed by this printer 3 is described first.

As shown in FIG. 3, the stamp is store information (I0) that is printed at the beginning of the receipt R, and is information that is common to every receipt R and is printed on the same side as transaction information before the transaction information is printed. FIG. 3 shows an example in which a store logo is not included in the store information. The command for printing this stamp is located next after the initialization command in the commands for printing one transaction (one receipt) when received from the POS terminal 2 shown in FIG. 1 based on the printing position of the stamp. In other words, the stamp printing command is the first command in the group of commands specifying the print content. The image printed as this stamp is output from the logo storage unit 36 and/or character generator 34 described above.

As also shown in FIG. 3, the detail is the main part of the receipt R and lists the name and price of the purchased products as well as the transaction total, and the image printed in this part is output primarily from the character generator 34. The barcode includes a transaction ID identifying the transaction, and the image printed here is output from the barcode generator 35. This detail and the barcode are the transaction information I1 of the receipt R, and when received from the POS terminal 2 the detail and barcode commands for printing this content sequentially follow the stamp command in the group of commands for one transaction.

In this embodiment the detail portion is divided and printed on side A and side B of the receipt R so that the trailing ends of the information printed on side A and side B are at substantially the same position when the receipt R is cut by the automatic cutter 45.

Note that while not shown in this example advertising or coupon information may be printed after the barcode on side B is printed. In this case, this information is preferably allocated to and printed on side A and side B of the receipt R so that the ends of the information printed on side A and side B are at substantially the same position and wasted white space is not created on the paper.

An important feature of this printer 3 is that when printing a receipt R as described above, the size of the printed stamp (the height as seen in FIG. 3), that is, the length of the paper 48 in the conveyance direction, is less than or equal to the distance between the automatic cutter 45 and printhead A 41 in the conveyance direction. More specifically, the length of the stamp and the distance between the automatic cutter 45 and printhead A 41 is substantially the same, with the length of the stamp preferably slightly shorter.

Receipt Printing Process

Figure 4:
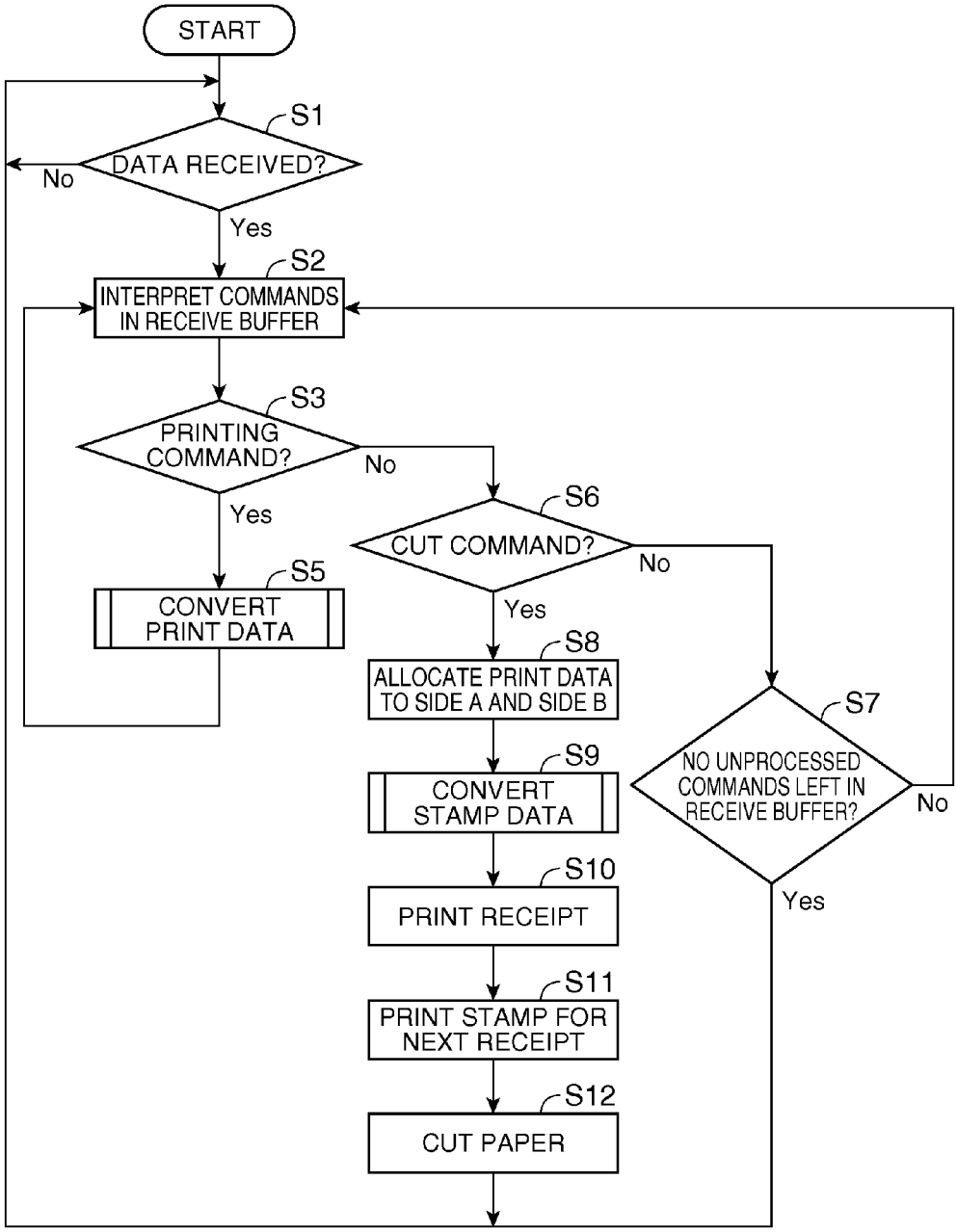
FIG. 4 is a flow chart of a receipt printing process.
Figure 5:
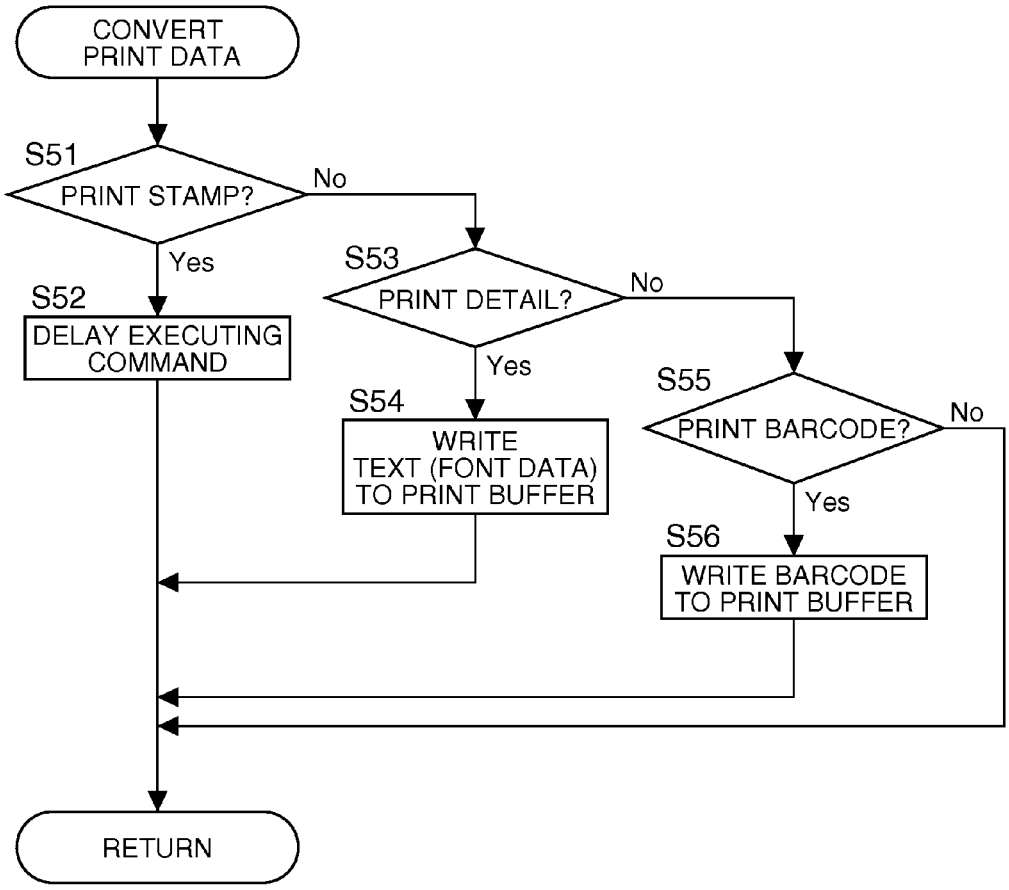
FIG. 5 is a flow chart of a print data conversion process.
Figure 6:
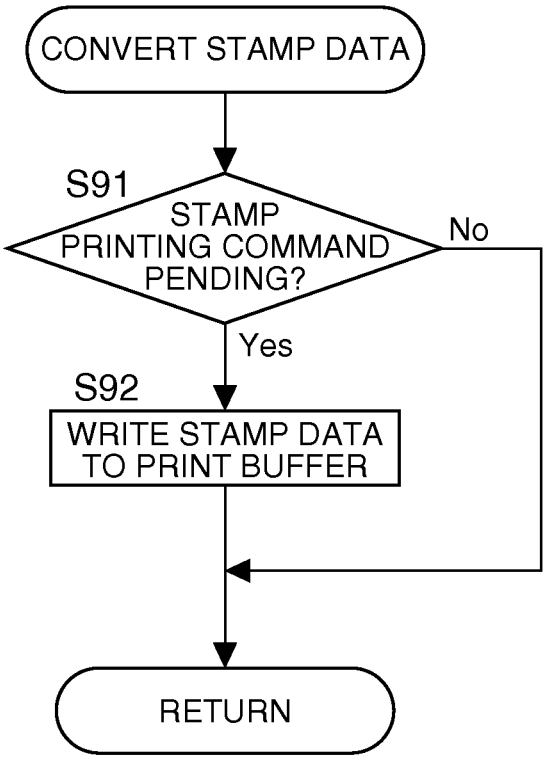
FIG. 6 is a flow chart of a stamp data conversion process.

A specific example of a receipt printing process in this printer 3 is described next with reference to FIG. 4, FIG. 5, and FIG. 6. FIG. 4 is a flow chart of a receipt printing process. FIG. 5 is a flow chart of a print data conversion process, and FIG. 6 is a flow chart of a stamp data conversion process.

Processing a single transaction is described below. First, as shown in FIG. 4, the printer 3 waits to receive the foregoing commands (print data) sent from the POS terminal 2 (step S1 returns No). When commands are received and stored in the receive buffer 31 (step S1 returns Yes), the command interpreter 32 sequentially interprets the commands in the receive buffer 31 (step S2).

Based on the result of command interpretation, the command interpreter 32 determines if the command is a printing command (step S3). A printing command as used here means a command that controls printing content (store information, transaction information) on a receipt R. Because an initialization command is usually first in the group of commands for printing a receipt for one transaction, the first command interpreted will be determined to not be a printing command (step S3 returns No), and the process goes to step S6.

Whether the interpreted command is a cut command is then determined in step S6. This cut command is a command instructing the automatic cutter 45 to cut the paper 48, and declares the end of one transaction. More specifically, this command is usually the last command. Therefore, because the command is an initialization command, or is a printer 3 status request command asking, for example, if there is paper 48, and is not a cut command (step S6 returns No), the specific instructions contained in the command are executed, and the process then goes to step S7.

Step S7 determines if there are any unprocessed commands in the receive buffer 31. Because unprocessed printing commands, for example, have usually been received at this time (step S7 returns No), the process returns to step S2 and the next command is interpreted.

Returning to step S3, when the initialization command or status request command has been processed, a printing command for the stamp described above is usually interpreted, is identified as a printing command (step S3 returns Yes), and the print data conversion process is executed (step S5).

This print data conversion process is described with reference to FIG. 5. As shown in FIG. 5, the command interpreter 32 first determines in the print data conversion process whether the interpreted printing command relates to the stamp, relates to the detail, or relates to the barcode (steps S51, S53, S55). If the interpreted printing command relates to the stamp (step S51 returns Yes), the command interpreter 32 delays executing the command (step S52). That command execution is pending is also stored. Because the conversion process is not applied to the stamp data in this process, bitmap data for the stamp is not stored in the print buffer 39 at this time.

If the command relates to the detail (step S53 returns Yes), the font data output from the character generator 34 because the detail is usually text is converted to bitmap data by the data conversion unit 37, and the resulting bitmap data is stored in the print buffer 39 (step S54).

If the command relates to the barcode (step S55 returns Yes), the barcode data output by the barcode generator 35 is converted to bitmap data by the data conversion unit 37, and the resulting bitmap data is stored in the print buffer 39 (step S56).

When the process of step S5 in FIG. 4 is performed and processing the printing commands ends, the cut command at the end of the transaction is interpreted by the command interpreter 32 (step S3 returns No, and step S6 returns Yes), and the process goes to step S8.

In step S8 the bitmap data expressing the transaction information sequentially written to the print buffer 39 is divided into data printed on side A of the paper 48 and data printed on side B. As shown in FIG. 2, the bitmap data representing the transaction information for one transaction is divided so that the length of the transaction information printed on side B is longer than the length of the transaction information printed on side A by an amount substantially equal to the distance between printhead A 41 and printhead B 42. By thus dividing the bitmap data, the trailing ends of the information printed on side A and side B will be at substantially the same position after the receipt R is cut by the automatic cutter 45, and wasted white space will not be formed on the paper.

More specifically, the start address and end address identifying where the data printed on side A is stored in the RAM constituting the print buffer 39, and the start address and end address identifying where the data printed on side B is stored, are temporarily stored in a register not shown, and the bitmap data is thus separated. As described below, data is then transferred from the print buffer 39 to the printheads (41, 42) by referencing the addresses temporarily stored in the register not shown.

The stamp data conversion process is then executed in step S9. The stamp data conversion process is described with reference to FIG. 6. FIG. 6 is a flow chart of this process. In the stamp data conversion process, the command interpreter 32 checks if there is a pending stamp data printing command (step S91). If a command is not pending (step S91 returns No), this process ends.

If a command is pending (step S91 returns Yes), the command interpreter 32 commands a stamp conversion process, the data conversion unit 37 converts the data output from the logo storage unit 36, for example, to bitmap data, and the resulting bitmap data is stored in the print buffer 39 (step S92). Bitmap data for the detail and barcode data already allocated to the opposite sides of the paper is normally stored in the print buffer 39 at this time, and the stamp data is stored thereafter. More specifically, the start address and end address identifying where the stamp data is stored in RAM used as the print buffer 39 are also temporarily stored in the register.

Referring again to FIG. 4, because the cut command declaring the end of one transaction has already been received and interpreted, the printer 3 starts the printing process, and the bitmap data for printing on side A and the bitmap data for printing on side B stored in the print buffer 39 are sequentially read and sent to the respective printheads (41, 42).

When the printing process starts, the paper feed motor 46 is driven and starts conveying the paper 48, and printing by the printheads (41, 42) on both sides starts at the same time. On side A, bitmap data is sent from the print buffer 39 to the printhead A 41 sequentially from the start address identifying where the data to be printed on side A is stored, and part of the detail is printed by printhead A 41. On side B, bitmap data is sent from the print buffer 39 to the printhead B 42 sequentially from the start address identifying where the data to be printed on side B is stored, and the remaining part of the detail and the following barcode are printed by printhead B 42. Receipt printing ends when all data for printing on side A and side B has been sent from the print buffer 39 to the printheads (41, 42) (step S10).

Printing the receipt for the current transaction (receipt) is finished by the printing process to this point. The stamp portion of this transaction was not printed, but the stamp for this receipt was already printed at the downstream end of the paper 48 in the previous printing process in the printing method of the printer 3 according to this embodiment of the invention.

Without stopping paper 48 conveyance, the printer 3 executes a printing process based on the bitmap data for the stamp stored in the print buffer 39 following the barcode by the operation in step S92 described above (step S11). The stamp is printed on side A of the paper by the printhead A 41, but this stamp is printed for the next transaction and the printed stamp is located at the leading end part of the next receipt. More specifically, bitmap data is sent sequentially from the start address to the end address of the stamp data in the print buffer 39 to the printhead A 41, and printing a stamp with the printhead A 41 then ends.

When printing the stamp ends, printing by the printheads (41, 42) ends, the paper 48 is conveyed until the automatic cutter 45 is positioned between the printed barcode and the printed stamp, the paper feed motor 46 then stops, and paper 48 conveyance stops.

The paper 48 is then cut by the automatic cutter 45 (step S12), the receipt printed for the current transaction is discharged from the paper exit 52, and the receipt printing process ends. The stamp printed in the previous process and part of the detail printed in the current process are printed sequentially on side A of the issued receipt, and the remaining part of the detail printed in the current process and the barcode are sequentially on side B, resulting in a receipt such as shown in FIG. 3.

The relative positions of the paper 48 in the foregoing printing process are described next with reference to FIG. 2. In FIG. 2, (*c*) and (*d*) show the position of the paper 48 and the condition of each side (side A and side B) when the printing process starts (step S10 in FIG. 4). In FIG. 2 the store logo I0 shown with a solid line is the stamp that was already printed in the previous printing process. Transaction information A I1, transaction information B I1, and store logo I3 shown with dotted lines show the printing position of the information that has not been printed and will be printed in the current printing process. Note that the transaction information I1 includes the detail and barcode as described above, and store logo I3 is a stamp.

When printing starts the paper 48 moves in the direction of the arrow in the figure, and printing by printhead B 42 and printhead A 41 starts simultaneously. Printing starts from position P1 in the figure on side B, and printing starts from position P2 in the figure on side A. Conveyance of the paper 48 and printing then proceed, and printing the transaction information I1 ends when position P3 on the paper 48 reaches the position of printhead A 41.

As described above, the printing process then continues on side A, store logo I3 is printed, and the paper 48 is conveyed to the cutting position. FIGS. 2 (*a*) and (*b*) show the position of the paper 48 and the state of each side (side B and side A) at this time. Note that transaction information A I1, transaction information B I1, and store logo I3 have already been printed and are therefore shown with solid lines.

Because the length of the store logo I3 in the paper conveyance direction is substantially equal to and slightly shorter than the distance in the paper conveyance direction between the automatic cutter 45 and printhead A 41, paper conveyance stops immediately after printing store logo I3 ends, and the paper 48 stops as shown in (a) and (b).

As described above, because the length of the store logo I3 is less than the distance between the automatic cutter 45 and printhead A 41, when printing the store logo I3 ends, the printed store logo I3 will not be exposed downstream in the conveyance direction from the automatic cutter 45. Because cutting should occur between the transaction information I1 and the store logo I3 for the next receipt, limiting the length of the store logo I3 means there is no need to convey the paper 48 in reverse.

If the length of the store logo I3 is significantly shorter than this separation distance between the automatic cutter 45 and printhead A 41, noticeable white space will occur between the store logo I0 and the transaction information I1, adversely affecting efficient use of paper and receipt appearance.

After stopping paper feed, the paper is cut at position P4 in the figure, that is, between the end of transaction information I1 and the beginning of the store logo I3, and the portion labelled R in the figure will be issued as a receipt for the current transaction. The resulting receipt uses the store logo I0 printed in the last printing process, and the store logo I3 printed in the current process is used for the next receipt.

A receipt R with a good appearance and little white space on the side (side A) where transaction information I1 is printed can thus be printed without conveying the paper 48 in reverse.

As described above, when producing a receipt with part of the transaction information (transaction information A) printed on one side and the remaining part of the transaction information (transaction information B) printed on the other side, a printer 3 according to this embodiment of the invention prints part of the transaction information using the printhead located on the upstream side in the conveyance direction of the paper. The length of the store information such as a store logo that is printed before transaction information is a length that fits in the distance between the automatic cutter and the printhead, data for the store information is stored before printing at a position resulting in the store information being printed after the transaction information, and after printing the transaction information and the following store information, the paper is cut at a position between the printed transaction information and the store information, producing a receipt.

The printed store information therefore remains between the automatic cutter and the printhead, and by starting printing therefrom when the next receipt is printed, a receipt having store information desirably printed at the beginning can be produced. As a result, paper wasted by white space can be reduced without conveying the paper in reverse. In addition, because the paper is not conveyed in reverse, the printer is mechanically simple and time for reversing the paper is not needed.

In addition, by limiting the length of the store information to slightly less than the distance between the automatic cutter and the printhead, receipts with a good appearance can be produced.

Note that this embodiment of the invention uses a thermal printer as the printer 3, but the printer 3 could be an inkjet printer with a line head. Receipts can also be printed as described above when printing with an inkjet printhead, but time for the ink to dry after printing must be considered when using an inkjet printer. However, by using the receipt printing method of the invention, sufficient time for the ink to dry can be assured even when printing a store logo or other content with a high print density as the store information because the store information is printed when printing the previous receipt.

The POS terminal 2 and printer 3 are separated in the foregoing embodiment, but the invention can obviously also be applied when these are combined in a single unit.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A double-sided receipt printing method for a device that prints transaction information and store information for each transaction on paper, and produces a receipt using both sides of the paper, wherein:

the device has a first printhead that prints on one side of the paper, a second printhead that prints on the other side of the paper, and a cutter disposed to the paper conveyance path with a specific gap therebetween approaching a paper exit for the paper, and a conveyance unit that conveys the paper through the conveyance path; and the printing method comprises steps of:

starting conveyance of the paper by the conveyance unit, printing part of the transaction information by the first printhead, and printing the remaining part of the transaction information by the second printhead, based on reception of a transaction end statement;

printing the store information, the length of which in the paper conveyance direction is a length that fits between the cutter and the first printhead, by the first printhead after printing the transaction information; and stopping conveyance by the conveyance unit after printing the store information, and cutting the paper by the cutter at a position between the area where the transaction information was printed and the area where the store information was printed.

2. The double-sided receipt printing method described in claim 1, further comprising a step of:

dividing the transaction information for each transaction into transaction information printed by the first printhead and the second printhead before printing the transaction information.

3. The double-sided receipt printing method described in claim 2, wherein:

the transaction information for each transaction is divided so that the length of the transaction information printed by the second printhead is greater than the length of the transaction information printed by the first printhead by an amount equal to the distance between the first printhead and second printhead.

4. The double-sided receipt printing method described in claim 1, wherein:

the length of the store information is shorter than the distance between the cutter and the first printhead.

5. A double-sided receipt printer that prints transaction information and store information for each transaction on paper, and produces a receipt using both sides of the paper, wherein the printer has:

a first printhead that prints on one side of the paper, a second printhead that prints on the other side of the paper, and a cutter disposed to the paper conveyance path with a specific gap therebetween approaching a paper exit for the paper, and a conveyance unit that conveys the paper through the conveyance path; and starts conveyance of the paper by the conveyance unit, prints part of the transaction information by the first printhead, and prints the remaining part of the transaction information by the second printhead, based on reception of a transaction end statement;

prints the store information, the length of which in the paper conveyance direction is a length that fits between the cutter and the first printhead, by the first printhead after printing the transaction information; and stops conveyance by the conveyance unit after printing the store information, and cuts the paper by the cutter at a position between the area where the transaction information was printed and the area where the store information was printed.

6. The double-sided receipt printer described in claim 5, further comprising:

a data allocation unit that divides the transaction information for each transaction into transaction information printed by the first printhead and the second printhead before printing the transaction information.

7. The double-sided receipt printer described in claim 6, wherein:

the data allocation unit divides the transaction information for each transaction so that the length of the transaction information printed by the second printhead is greater than the length of the transaction information printed by the first printhead by an amount equal to the distance between the second printhead and first printhead.

* * * * *